US008043045B2

(12) United States Patent
Clark et al.

(10) Patent No.: US 8,043,045 B2
(45) Date of Patent: Oct. 25, 2011

(54) ACTUATOR

(75) Inventors: Daniel Clark, Derby (GB); John R Webster, Derby (GB)

(73) Assignee: Rolls-Royce plc, London (GB)

( * ) Notice: Subject to any disclaimer, the term of this patent is extended or adjusted under 35 U.S.C. 154(b) by 1147 days.

(21) Appl. No.: 11/822,195

(22) Filed: Jul. 3, 2007

(65) Prior Publication Data

US 2008/0145204 A1 Jun. 19, 2008

(30) Foreign Application Priority Data

Jul. 15, 2006 (GB) ..... 0614114.7

(51) Int. Cl.
*F01D 21/12* (2006.01)

(52) U.S. Cl. ..... 415/48; 416/23; 416/29; 416/223 R; 60/527; 60/528

(58) Field of Classification Search ..... 415/12, 415/48; 416/23, 39, 132 A, 135, 223 R, 224; 60/527, 528
See application file for complete search history.

(56) References Cited

U.S. PATENT DOCUMENTS

| | | | | |
|---|---|---|---|---|
| 3,764,227 | A * | 10/1973 | Albertzart | 416/39 |
| 4,305,699 | A * | 12/1981 | Martinelli | 416/226 |
| 5,129,787 | A * | 7/1992 | Violette et al. | 416/226 |
| 5,150,864 | A | 9/1992 | Roglin | |
| 6,000,908 | A * | 12/1999 | Bunker | 416/95 |
| 6,015,263 | A * | 1/2000 | Morris | 416/132 A |
| 6,116,539 | A * | 9/2000 | Williams et al. | 244/46 |
| 6,231,006 | B1 | 5/2001 | Gruensfelder | |
| 6,465,902 | B1 * | 10/2002 | Beauchamp et al. | 290/55 |
| 6,813,877 | B2 | 11/2004 | Birch | |
| 2004/0067134 | A1 * | 4/2004 | Beauchamp et al. | 416/37 |
| 2004/0197519 | A1 * | 10/2004 | Elzey et al. | 428/68 |
| 2005/0229585 | A1 | 10/2005 | Webster | |
| 2006/0018761 | A1 * | 1/2006 | Webster et al. | 416/233 |
| 2006/0140772 | A1 * | 6/2006 | McMillan et al. | 416/241 R |

FOREIGN PATENT DOCUMENTS

EP 643218 A1 3/1995

(Continued)

OTHER PUBLICATIONS

European Search Report for corresponding European Application (completed Jan. 25, 2011).

*Primary Examiner* — Edward Look
*Assistant Examiner* — Aaron R Eastman
(74) *Attorney, Agent, or Firm* — Jeffrey S. Melcher; Manelli Selter PLLC

(57) ABSTRACT

Actuators utilising shape memory alloy materials are known with regard to gas turbine engines. Such shape memory alloys have been used with respect to deformation provided in vanes and blades as well as nozzle elements in order that variations can be made in engine configuration dependent upon thermal cycling. Unfortunately, pedestals in order to provide spacing between the shape memory alloy and an antagonistic bias has resulted in uneven stress distribution as well as a higher thermal mass for the shape memory alloy. An uneven stress distribution will limit operational life whilst a higher thermal mass will result in slower reaction times. By separation of the shape memory alloy or material from its antagonistic bias through use of a slide element, a reduction in thermal mass is achieved and, more importantly, stress differentiation across the actuator is reduced.

18 Claims, 9 Drawing Sheets

FOREIGN PATENT DOCUMENTS

| | | | |
|---|---|---|---|
| EP | 1130257 | A2 | 9/2001 |
| EP | 1612373 | A2 | 1/2006 |
| GB | 2 068 545 | A | 8/1981 |
| GB | 2068545 | A | 8/1981 |
| GB | 2 315 126 | A | 1/1998 |
| GB | 2 374 121 | A | 10/2002 |
| WO | 9534189 | A1 | 12/1995 |

* cited by examiner

ACTUATOR

CROSS-REFERENCE TO RELATED APPLICATIONS

This application claims foreign priority to United Kingdom Patent Application No. GB 0614114.7, filed 15 Jul. 2006.

BACKGROUND OF THE INVENTION

The present invention relates to actuators and more particularly to actuators utilised within gas turbine engines in order to vary blade or vane or nozzle tab configuration.

Use of shape memory materials such as shape memory alloys is well known in order to achieve variation in dimensions or actuation by such deformation. Typically, the shape memory alloy or material acts against a bias in the form of a mechanical spring. An example of a prior use of shape memory materials is given in U.S. Pat. No. 6,813,877 in relation to nozzle tabs and fins adjustable dependent upon exit temperatures from a gas turbine engine.

Generally, a spacing pedestal must be provided between the shape memory alloy or material. The spacing pedestals secured to the shape memory alloy create stress rising features and so do not allow the full potential of the shape memory material deformation to be utilised for actuation. By increasing the potential working area per unit volume of the shape memory material, greater performance can be achieved whilst providing a more uniform stress distribution, which in turn should increase operational life and/or loading.

Previous approaches have generally implied a necessity to achieve a two dimensional design and loading structure whilst certain situations require a three dimensional application such as changing an air flow direction or aperture size so that consideration must be made to utilisation of a faster design which in turn is less efficient.

SUMMARY OF THE INVENTION

In accordance with aspects of the present invention there is provided an actuator for a gas turbine engine, the actuator comprises a shape memory material arranged to act against a bias with a slide element between them, the shape memory material separate from the slide element.

Typically, the shape memory material is a shape memory alloy.

Typically, the shape memory material is a sheet. Alternatively, the shape memory material provides a wire or rope or strand. Further alternatively, the shape memory material comprises a bespoke shaped and formed element to provide desired actuation. Possibly, the shape memory material comprises a cage. Further potentially, the shape memory material comprises a U shaped channel.

Typically, the slide element comprises a roller. Alternatively, the slide element comprises a pedestal. Further alternatively, the slide element comprises a groove and/or guide eyes. Additionally, the slide element may comprise a dowel. Potentially, the slide element incorporates a spacer between displaceable parts of the actuator. Potentially, the spacer incorporates rebated channels to engage and guide movement of moveable parts of the actuator.

Possibly, the slide element comprises balls or other bearings.

Possibly, the slide element is hollow.

Possibly, the slide element incorporates location flanges. Possibly the slide element is filled with a low thermal mass material.

Typically, the actuator is curved. Possibly, the actuator is a blade or vane expander in a gas turbine engine.

Also in accordance with aspects of the present invention there is provided an actuator arrangement comprising a plurality of actuators, as described above, mechanically coupled for co-ordinated action.

Potentially, the slide elements provide a lateral stiffness in an actuator structure.

Possibly, the actuator incorporates an encapsulated wax to provide structural rigidity.

Possibly, the slide elements are located within a frame.

BRIEF DESCRIPTION OF THE DRAWINGS

Embodiments of the present invention will now be described by way of example and with reference to the accompanying drawings in which.

DETAILED DESCRIPTION OF THE INVENTION

As indicated above, use of shape memory materials and alloys in order to provide actuation is known. However, previous arrangements have particular problems with respect to stress distribution through the actuator arrangement, and also it will be understood that separating the shape memory alloy or material will provide benefits with respect to a lower thermal mass in intimate contact with the shape memory material, such that this shape memory material will heat faster and cool quicker through thermal cycling such that the actuator device has a faster response.

Aspects of the present invention provide separation of the shape memory alloy from other parts of the actuator through use of a slide element such as balls, rollers or other features whereby the shape memory alloy can essentially slide upon the slide element to provide less constriction and therefore more uniform stress distribution to increase life and device loading. It will also be understood by separation of the shape memory alloy or material there is less direct thermal mass in intimate contact with the shape memory material such that, as indicated above, it will heat faster and similarly cool quicker resulting in an actuator which has a faster response time. It is implicit that the shape memory alloy or material will deform in accordance with its nature through a temperature range. By aspects of the present invention, as indicated, a slide element is provided to allow separation between the shape memory alloy or material and an antagonistic bias to return that material to its original form. As will be described later, the slide element may comprise a number of association mechanisms including rollers, ball bearings and slide surfaces to ensure appropriate presentation of the shape memory alloy relative to the bias typically in the form of a spring material or mechanical spring.

Figure 1:
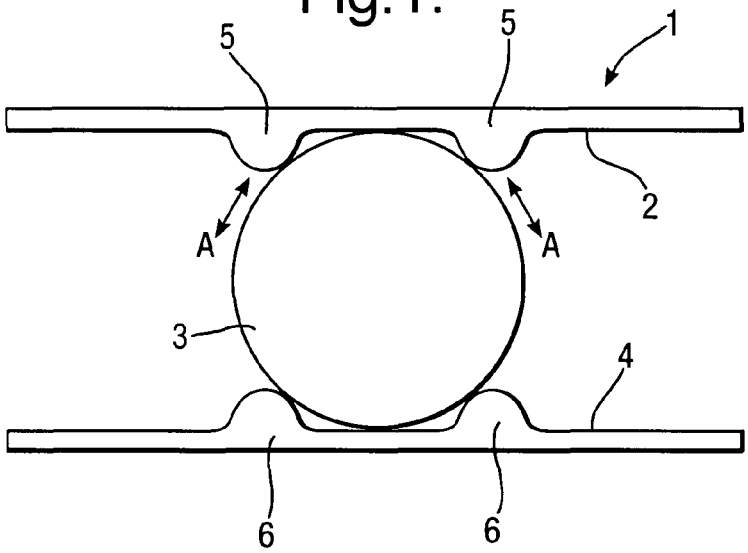
FIG. 1 is a schematic cross section of a first embodiment of an actuator in accordance with aspects of the present invention.

FIG. 1 provides a schematic side illustration of a first embodiment of an actuator 1 in accordance with aspects of the present invention. As can be seen, the actuator 1 comprises a shape memory alloy 2 with a roller or ball bearing 3 located between that shape memory alloy or material 2 and a spring material 4. In such circumstances, the roller 3 is restrained between the shape memory alloy 2 and the spring material 4. This retention in the first embodiment depicted in FIG. 1 comprises a channel formed by raised portions 5, 6 in the respective materials 2, 4. In such circumstances, spacing is ensured between the materials 2, 4 whilst shape changes to the shape memory alloy 2 can be accommodated by slide or rotation of or upon the roller 3.

Although retaining features 5, 6 are illustrated on both sides of the roller 3 in the embodiment depicted in FIG. 1, this may not be necessary if constraint of the roller 3 can be provided by other means. In such circumstances, the shape memory alloy 2 may be flat with the bearing or roller 3 retained by retaining elements 6 in the spring material 4. Such an approach may reduce manufacturing costs and increase the deformation consistency of the shape memory alloy due to the consistent cross section of that alloy 2. It will be understood that cross sectional thickness is a significant determinant with regard to shape memory alloy mechanical properties.

Figure 2:
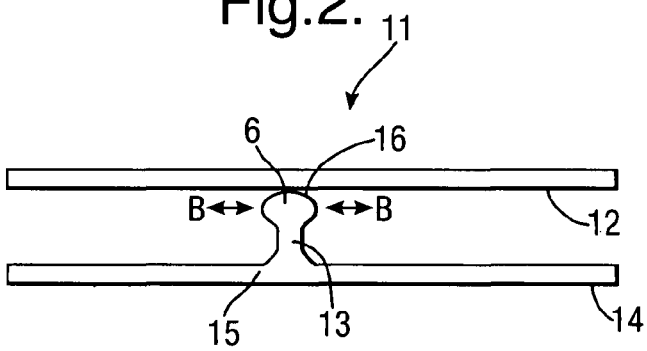
FIG. 2 is a schematic cross section of a second embodiment of an actuator in accordance with aspects of the present invention.

FIG. 2 provides a schematic cross section of a second actuator 11 in accordance with aspects of the present invention. In this second embodiment of an actuator 11 a flat shape memory alloy layer 12 slides relative to a pedestal portion 13 extending from a spring material layer 14. It will be understood that the pedestal is formed with an appropriate fillet radii 15 and central section in the form of a bulbous end 16 such that the pedestal 13 is appropriately presented and the bulbous end 16 allows bending of the shape memory alloy layer 12 thereabouts. Again, the shape memory alloy material will slide in the direction of arrowheads B such that spacing between the shape memory alloy layer 12 and the presenting spring material layer 14 is retained whilst thermal contact, as well as constraint of the layer 12, is limited.

The second embodiment depicted in FIG. 2 can be considered a rocker pedestal arrangement in view of the necessary bulbous end or other rounded aspects to the end 16 to allow the desired slide function.

Whether a roller or ball 3 or rocker pedestal 13 is used, it will be understood that there could be a single roll which could be held in place by the constraint of the counter posed spring 4, 14 in order to allow distortion in accordance with the nature of the shape memory alloy or material.

In order to ensure appropriate presentation between the shape memory material and the spring bias material, it will be understood that the rollers 3 or pedestal 13 could be flanged in order to guide and constrain the shape memory alloy layer or bias spring layer.

Thermal mass is a significant determinant with regard to reactivity of an actuator in accordance with aspects of the present invention. In such circumstances, the slide element, whether in the form of a roller 3 or rocker pedestal 13, may be hollow thereby reducing material weight as well as thermal mass. The slide element may be retained in a hollow configuration or the hollow cavity may be filled with a lighter, lower thermal mass, material which will then resist buckling whilst still providing a reduction in thermal mass in comparison with a solid slide element. A typical low thermal mass material, which could be utilised within the hollow cavity, would be a ceramic powder compact or rod. Further alternatively, the slide element could be rendered thermally conductive in order to provide a pathway for a heating and/or cooling fluid such as ducted air or fuel or water. Such an approach would provide reaction within the shape memory material as a result of that heating or cooling fluid flow. It will also be understood that the spacing between the shape memory alloy layer and the spring layer, if appropriately oriented, creates an interstices which can then be filled with a heating or cooling fluid flow as required.

When utilising rollers or bearings as illustrated in FIG. 1, it will be understood that position within the actuator in terms of lateral configuration may be achieved through inner roller or bearing contact and counter posed springs of the device acting as retaining walls.

As indicated, the slide element in accordance with aspects of the present invention may take the form of ball bearings. These ball bearings can be arranged to support a wide area of the actuator, for example a three dimensionally curved structure. To hold the balls in place an appropriate socket or pocket may be provided in the actuator. These sockets or pockets may be formed in a titanium spring layer 4, 14. Furthermore, it will be appreciated that the sockets or holes will generally be of a lower diameter than the ball bearings and would not necessarily need to completely penetrate the actuator structure.

In order to facilitate sliding, the rollers or ball bearings or rocker pedestals can be made from a heat insulating material such as ceramic, wood or composite fibreglass or hard polymer with an appropriate low coefficient of friction provided against the bias spring for spacing and presentation of the shape memory material. Such low coefficient of friction may be achieved by applying a coating or sleeve to the heat insulating material of the roller or ball bearing or rocker pedestal.

Ideally, the roller or ball bearings should have a low thermal mass in order not to add significantly to the overall actuator thermal hysterisis effects. As the rocker pedestal 13 depicted in FIG. 2 is directly integrally formed with the backer or spring layer 14 it will be understood that thermal contact will then be more direct and therefore there may be a significant thermal mass.

Aspects of the present invention allow deformation of three dimensional curvature shapes for the actuator in terms of the shape memory alloy deforming to a desired alternate shape over a thermal range. In such circumstances, generally the spacing between the shape memory alloy and the bias spring underlying material may vary over that three dimensional curvature structure. Typically, the rollers or ball bearings or rocker pedestals in accordance with the present invention will vary in size. In such circumstances, these ball bearings or rollers or rocker pedestals will typically decrease in size towards tips or edges of the three dimensional structure. In such circumstances the potential for deformation is reduced resulting in a structural stiffness which increases towards those tips or edges improving air deflection capability for a given blade weight.

It will also be understood that by providing hollow structures for the roller or bearing or rocker pedestal in accordance with aspects of the present invention, it is possible to incorporate vibration damping particulates for damping in the actuator.

As indicated above, it is relative slide between the presenting roller or ball bearing or rocker pedestal which allows separation of the shape memory layer in accordance with an actuator of aspects of the present invention. In such circumstances, it will be appreciated that the rollers or bearings or rocker pedestals may be replaced by a slide track. In such circumstances, the rollers or bearings or pedestal will move along a particular slide track during shape memory material deformation. FIGS. 3 and 4 schematically illustrate the range of shapes for an actuator in accordance with aspects of the present invention relative to a roller or ball bearing. The first embodiment, as described above, with regard to FIG. 1 in FIG. 3 or a rocker pedestal second embodiment of aspects of the present invention as depicted in FIG. 2 in FIG. 4.

Figure 3A:
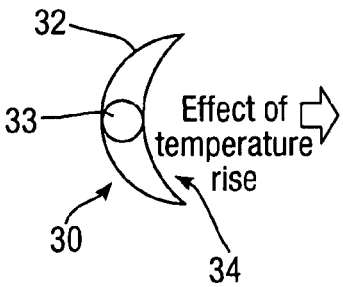
FIG. 3 is a schematic illustration of the first embodiment of an actuator in accordance with aspects of the present invention incorporated within a blade or vane expander.
Figure 3B:
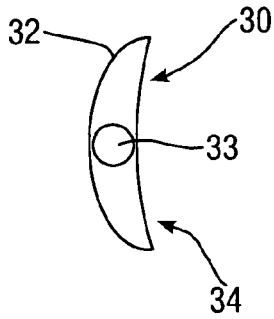

In FIG. 3 a shape memory material 32 on the convex side of a blade 30 is associated through a roller 33 with a spring 34. In such circumstances, during a temperature cycle between FIG. 3*a* and FIG. 3*b*, the shape memory material 32 deforms to alter the size and configuration of the blade 30. The deformation of the shape memory material 32 is against the bias provided by the bias layer 34. The roller 33 acts to allow relative movement to accommodate the deformation of the shape memory material 32 over the temperature cycle between FIG. 3*a* and FIG. 3*b*. Thus, the roller 33 maintains an appropriate spacing between the shape memory material 32 and the spring layer 34, but with reduced thermal contact and therefore thermal mass in the shape memory material causing a swifter reaction time to thermal changes. Typically, in use a number of rollers 33 will be provided but, nevertheless, it will be appreciated in view of the slide nature between the shape memory material 32 and the roller 33, less stress will be provided within the blade or vane 30.

Figure 4A:
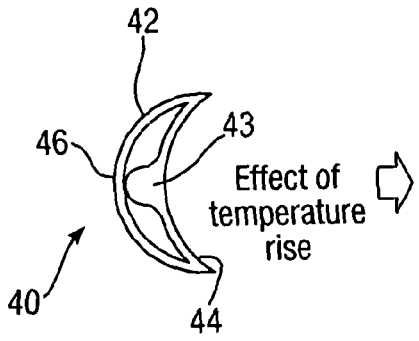
FIG. 4 is a schematic illustration of the second embodiment of the present invention depicted in FIG. 2 in accordance with aspects of the present invention incorporated within a blade or vane expander.
Figure 4B:
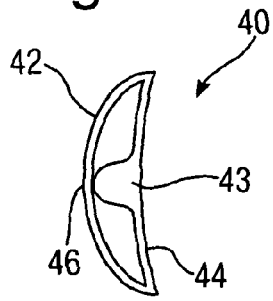

FIG. 4 operates in a similar manner to that with regard to the blade 30 depicted in FIG. 3. Thus, a blade 40 comprises a shape memory material 42 and a sprung material layer 44 with a rocker pedestal 43 between. As indicated previously, the rocker pedestal 43 includes a rounded upper surface 46 upon which the shape memory material layer 42 can slide whilst the pedestal 43 is directly integrally formed, or at least secured to the spring layer 44. In such circumstances, as indicated, slide may be provided relative to the deformation of the shape memory material over the temperature range between FIG. 4*a* and FIG. 4*b* resulting in a changing configuration of the blade or vane 40 over that temperature range. Thermal contact is limited and stressing is also limited due to the slide nature between the rounded end 46 of the pedestal 43 and the shape memory material 42. Nevertheless, the rocker pedestal 43 is integrally formed with the spring material potentially improving strength and ease of manufacture.

As indicated above previously, integral pillars provide a separation between a shape memory actuator working against a spring alloy such as steel or titanium. By aspects of the present invention this integral pillar is replaced by a rolling or sliding surface to achieve a smoother more efficient action during shape memory alloy deformation. Furthermore, by eliminating such integral pillars it will be appreciated it may be easier to fabricate and ensure appropriate operational functional life at a reduced cost for actuators in accordance with aspects of the present invention. In any event, providing integral pillars with regard to the shape memory alloy necessitates an awkward dissimilar alloy weld whilst aspects of the present invention providing a sliding action whether that be surface to surface or through rolling between the shape memory alloy and a slide element removes the necessity for such welds.

It will be understood that generally a number of actuators in accordance with aspects of the present invention will be utilised within an assembly such as a gas turbine engine in order to provide geometric and configurational changes during and over operational cycles for that gas turbine engine. Thus, for example, multiple actuators can be mechanically interlinked in order to change diameters in such situations as opening or closing arrangements at the nozzle of a gas turbine engine. The actuators will cause sliding tabs to move relative to the nozzle in order to change the diameter and by an actuator in accordance with the present invention less stress differentiation will be provided.

The slide elements in accordance with aspects of the present invention may also provide lateral stiffness if a three dimensionally shaped actuator device is required. If bent around a conical shape, the slide elements will not actually roll if rollers, but would allow sliding or rocking in order to achieve the necessary functional requirement. The rollers or rockers could hoop completely around an engine casing or could interlock in an appropriate pattern to help petals synchronise relative movement and load sharing.

It will also be understood that a spiral shape memory actuator could be provided with the spiral wound around the casing in order to facilitate manufacture with all rollers formed from the same long element. Nevertheless, account would then need to be taken with regard to radial thermal expansion and contraction when a wound shaped memory material is used. In such circumstances, with a hot long and cool short arrangement with a high coefficient of thermal expansion material there would be an inverse Poisson's relationship actuating structure constructed.

A further refinement with regard to an actuator in accordance with the present invention would utilise an encapsulated wax in the interstices to provide variation with regard to actuator response. It will be understood that the wax is solid when cold but can move when hot although generally dependent upon the type of wax used will still be viscose but pliable. In such circumstances, an actuator with a structural integrity more suited to austenitic temperature regions may be provided. In such circumstances, constraint of the actuator is allowed without compromising stiffness. As indicated, the wax would be confined and so consideration must be made with regard to thermal expansion in use. Nevertheless, use of encapsulated wax would provide good operational performance for low temperature shape memory alloys with transition temperatures up to about 150° C. Such shape memory alloys include nickel titanium type alloys. Furthermore, it would also be appropriate to use the hysterisis of the wax during thermal cycling to allow movement of the actuator device before the wax sets at cold temperatures. It will be appreciated that the wax hysterisis may be matched with the shape memory alloy for appropriate control movement.

Figure 5:
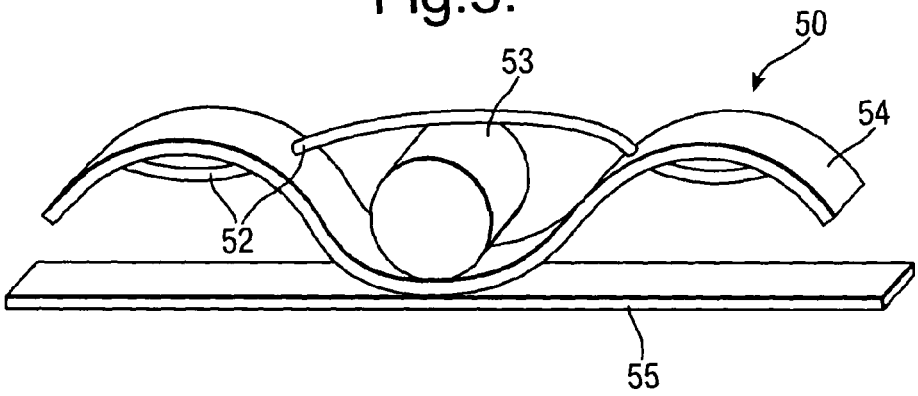
FIG. 5 is a schematic cross section of a third embodiment of an actuator in accordance with aspects of the present invention.

FIG. 5 illustrates a third embodiment of an actuator in accordance with aspects of the present invention. This actuator 50 comprises a shape memory alloy fibre or fibre bundle 52 interleaved with a bias in the form of a corrugated spring 54 with a spacer 53 in the form of a roller. The roller 53 will generally incorporate notches or grooves to guide and present the shape memory alloy fibre or wire 52. In such circumstances, the shape memory alloy wire and bias spring 54 are in an antagonistic relationship such that expansion or contraction of the shape memory alloy fibre 52 causes alterations in the configuration of the actuator whilst the spring 54 returns the actuator to a base state dependent upon the shape memory alloy condition. Optionally, a stiffening surface 55 may be added to provide a mounting for the actuator arrangement.

In use the shape memory alloy fibre or cable 52 may be attached to a device which requires actuation. In such circumstances, dependent upon the thermal cycle, the shape memory cable 52 will pull on that device in order to actuate it to an appropriate configuration. The spring bias 54 will return the shape memory alloy fibre 52 to its original state and therefore return the associated device to that state as required.

Generally, the slide elements in accordance with aspects of the present invention may be curved or tapered to suit a three dimensional curved structure in which the actuator is located.

In order to avoid ice or icing within an actuator in accordance with aspects of the present invention, an appropriate coating, such as polyethylene or TEFLON could be applied to the surfaces or a compliant rubber used to ensure slide association.

Figure 6:
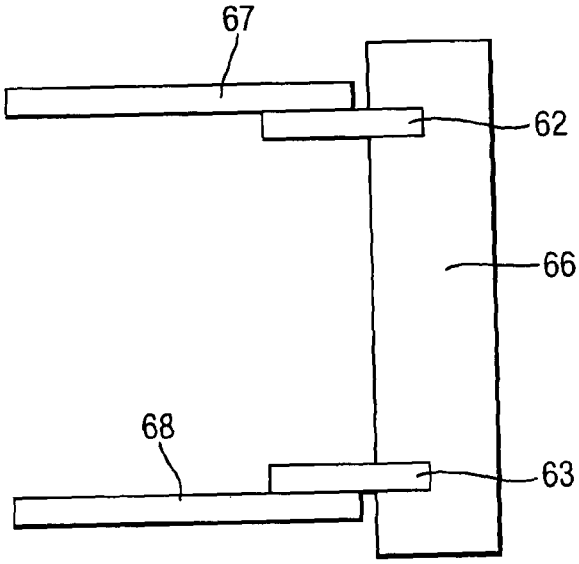
FIG. 6 is a schematic illustration of a fourth embodiment of an actuator in accordance with aspects of the present invention.

FIG. 6 illustrates a so called Belville washer type construction of an actuator in accordance with aspects of the present invention. In such circumstances, shape memory alloy spring bias components 62, 63 are associated through a box end section 66, where the shape memory alloy spring bias components 62, 63 which in turn are associated with non mechanically functional air deflection or cosmetic surfaces 67 and 68, respectively, which will generally be of a thin nature. In such circumstances, the box end section 66 will replicate, that is to say, mirror movement of a shell like flap component associated through the shape memory alloy spring bias components 62, 63. The box wall will allow sliding and end stiffening.

Figure 7:
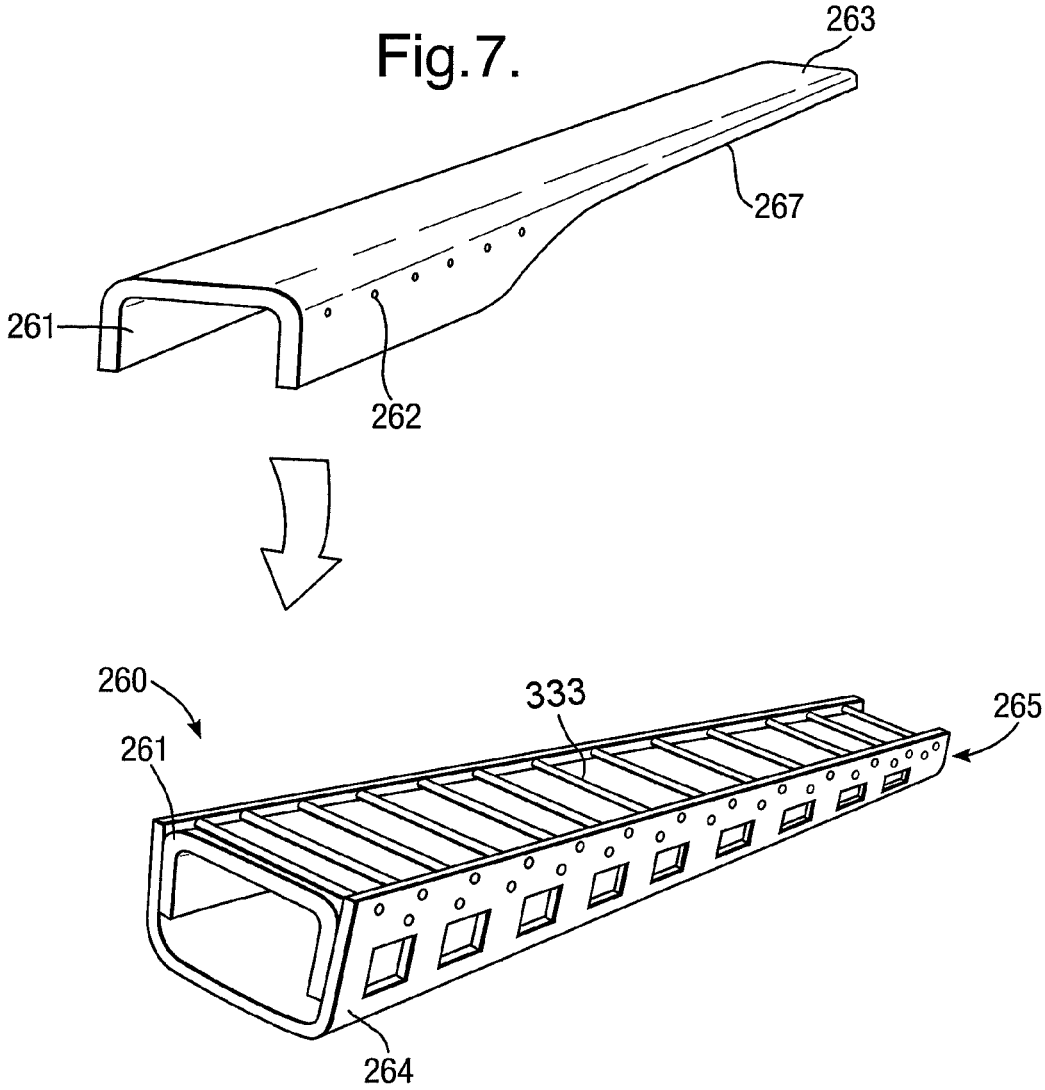
FIG. 7 is a schematic perspective view of a fifth embodiment of an actuator in accordance with aspects of the present invention.

FIG. 7 illustrates an actuator assembly or arrangement 260 in accordance with aspects of the present invention. A laser cut sheet 261 incorporates a row of dowel holes 262 to provide anchors for dowels typically formed from an austenitic stainless steel. The laser cut sheet 261 is bent such that its curvature provides structural stiffness. Dowels are located under a far end 263 of the sheet 261 to provide end support and stiffness. The sheet 261 is generally located within a U shape channel 264 and secured through dowels. The laser cut out sheet 261 and associated dowels creates with shape memory alloy an actuator in accordance with aspects of the present invention. Thus, at a near end the actuator has a depth in the order of 13 mm, whilst at a far end 265 a depth in the order of 5 mm. The length of the is in the order of 200 mm. The channel 264 typically has laser cut windows to reduce weight in the sides. In such circumstances shape memory elements 333 below the sheet 261 can be deformed with temperature in order to deflect the end 263 with slide association along an edge 267 between them.

Figure 8:
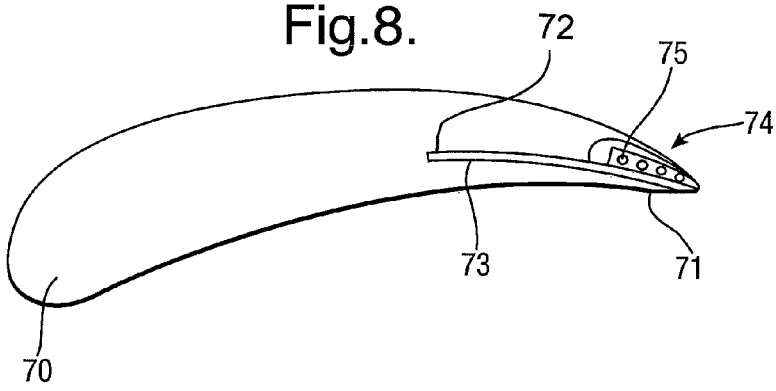
FIG. 8 is a schematic plan view of an actuator incorporated within a trailing edge of a blade or vane in accordance with aspects of the present invention.
Figure 9:
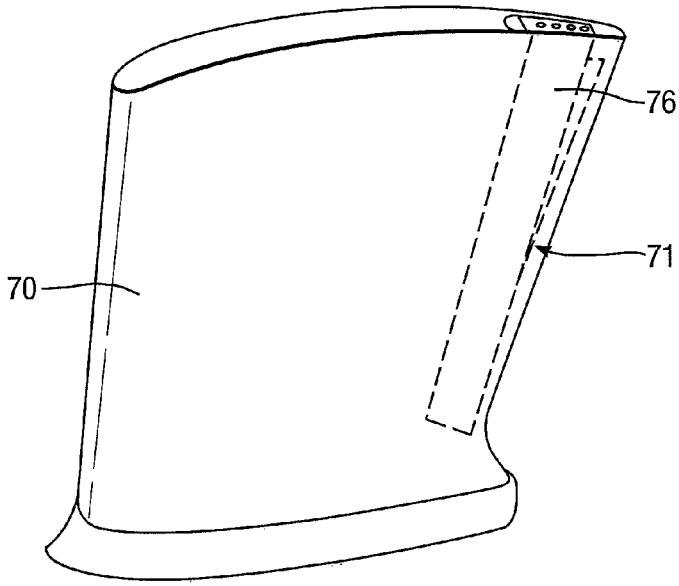
FIG. 9 is a schematic side illustration of the blade illustrated in FIG. 8.

FIGS. 8 and 9 respectively illustrate use of an actuator in accordance with a fifth embodiment of aspects of the present invention located within the trailing edge of a blade or vane of a gas turbine engine. FIG. 8 illustrates schematically a cross section such that an actuator 71 is located towards a trailing edge of the blade 70. The actuator 71 comprises a bimetallic titanium/shape memory alloy located appropriately in order to alter and deform over a temperature cycle. Typically, an additional length 72 of the actuator is provided to generate more force with respect to the shape memory alloy. An opposed surface 73 has a lower stiffness projecting to an air washed surface 74. In such circumstances, rollers or other slide elements 75 are provided within the actuator 71 in order that the shape memory alloy deforms over its thermal range, the rollers or other slide elements provide necessary deformation of the trailing edge of the blade 70 whilst avoiding stress differentiation across the actuator 71. The rollers or slide elements 75 provide separation stiffness against buffeting in use.

FIG. 9 provides a side perspective view of the blade 70. As can be seen, the actuator 71 is embedded along a rear edge of the blade or vane 70 where the skin thickness narrows to in the order of 0.6 mm to allow a flexible pocket for the actuator 71 to be inserted therein. It is possible one of the vane walls becomes part of the actuator typically on the titanium or sprung bias side separated by the rollers (75 in FIG. 8) inserted vertically at the same time.

In view of the above, it will be appreciated that the blade or vane could be fabricated using an existing vane or blade approach. Electro spark machining to remove a cavity 76 for the actuator then inserting the shape memory alloy side of the actuator with rollers or surrounded by a wax for location and low friction upon insertion. The wax can then be removed by melting out.

Figure 10:
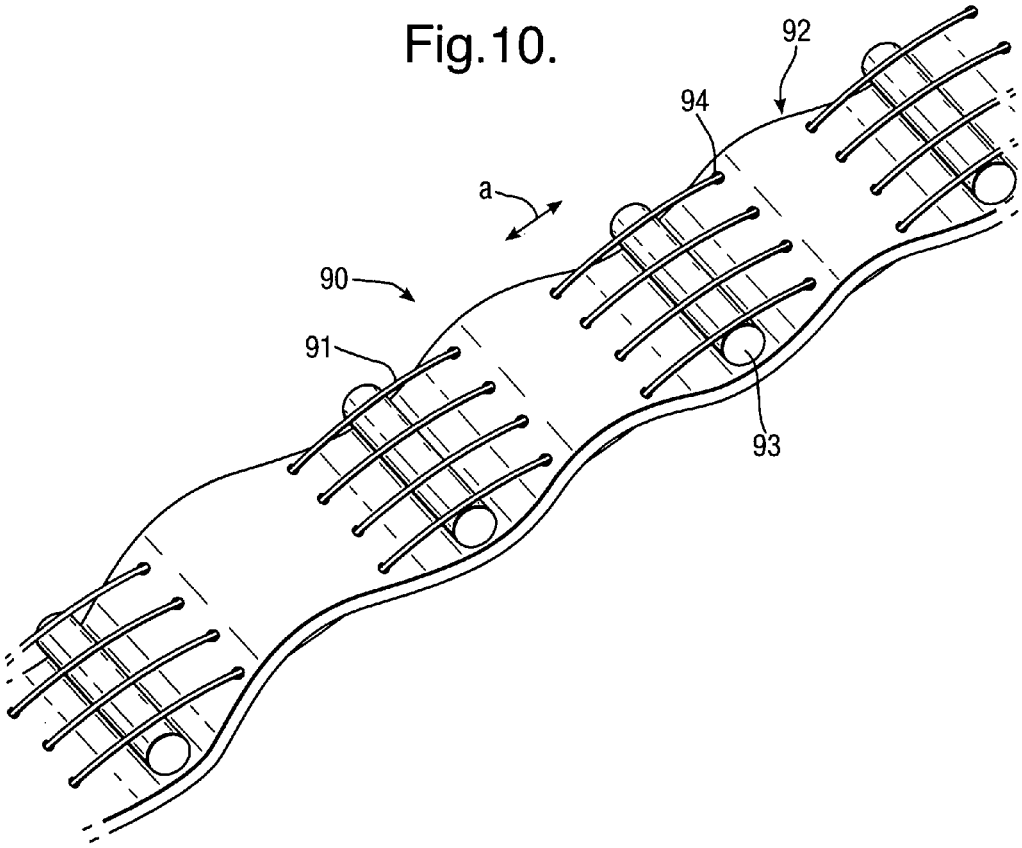
FIG. 10 is a schematic illustration of a sixth embodiment of an actuator in accordance with aspects of the present invention.
Figure 11:
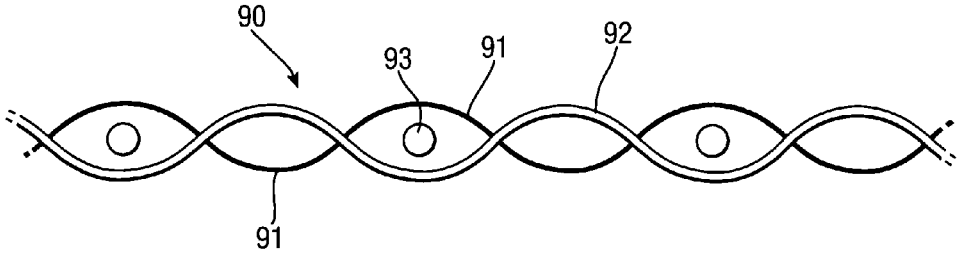
FIG. 11 is a side view of a perspective of the sixth embodiment of aspects of the present invention depicted in FIG. 10.

FIGS. 10 and 11 illustrate a sixth embodiment of aspects of the present invention. In such circumstances, an actuator or, as illustrated, a plurality of actuators, are provided in an actuator arrangement 90 comprising respective rollers 93 located in between shape memory alloy or material fibre strands 91 and a bias spring corrugated sheet 92. The sheet 92 incorporates perforations 94 through which the strands or fibres 91 extend. In such circumstances, as indicated previously, the shape memory fibres act against the bias of the sheet 92 in order to flex in the direction of arrowheads a. This flexing provides actuation by deformation. This deformation is due to the shape memory alloy fibres varying their shape over a temperature range.

The perforations 94 will generally be cut into the sheet 92 through a laser process. In order to reduce wear, the perforations may be filled with a low friction brush or sleeve or tube to protect the shape memory alloy fibres 91 from chafing. Furthermore, inserted tubes could extend all or part of the length of the gap between apertures 94 further stiffening the arrangement. In any event, the shape memory fibres and wires 91 slide over the rollers 93 such that stressing of those fibres 91 as well as the actuator 90 overall is more uniformly distributed.

Figure 12:
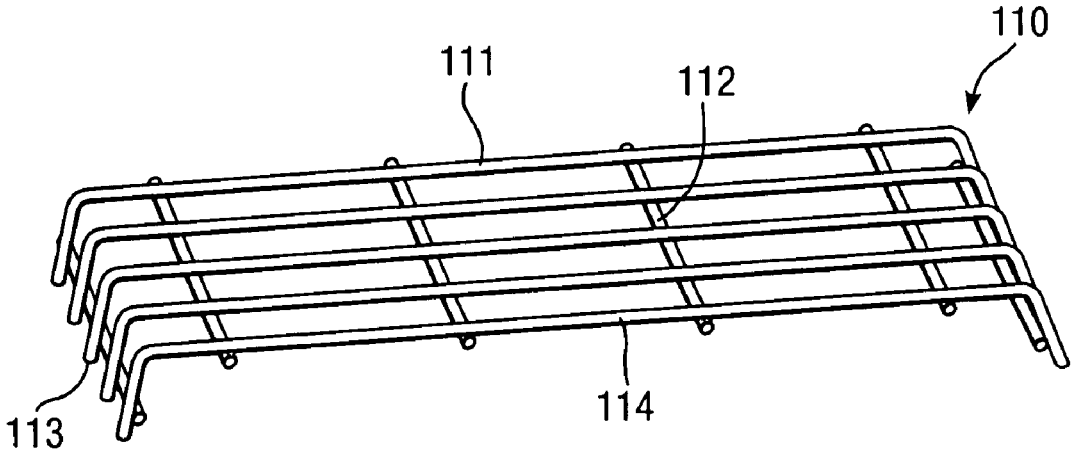
FIG. 12 is a schematic illustration of a shape memory material cage in accordance with aspects of the present invention.

FIG. 12 illustrates a further alternative with regard to shape memory wires. In the seventh embodiment depicted in FIG.

12 the wires are associated together into a cage 110 or wire frame structure 110. The cage or wire frame structure 110 is generally spot or otherwise welded at the junctions to create the cage 110. The cage, as indicated, is formed from shape memory wires 111 which are formed into a frame structure by cross members 112 which may also be shape memory wires. The wires 111, 112 and their respective free ends 113, 114 may be looped in order to provide mountings for the frame or cage 110 appropriately. The wires are typically formed from shape memory alloy fibre bundles.

Figure 13:
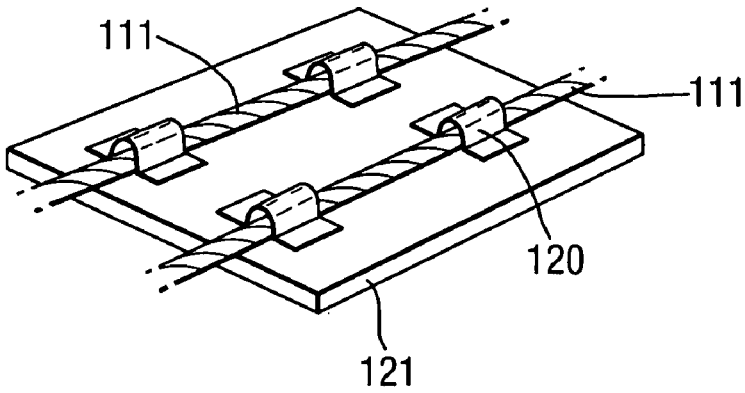
FIG. 13 is a perspective schematic view of eyelets to secure shape memory material in the form of a rope or wire.

The frame or cage 110 can be bonded, welded or brazed or mechanically attached to a sheet metal air wash surface such that the temperature cycling of that air was surface will cause deformation of the shape memory alloy or material within the frame 110 to cause actuation. To allow such attachment, as illustrated in FIG. 13, guide eyes 120 can be provided through which the shape memory alloy wires pass. The guide eyes 120 are typically spot welded to an underlying sheet structure as described above. By such threading of the wire 111 through eyes 120, metal injected moulded scales or thin sheet or a series of overlapping sheets can be deflected by the actuation caused by deformation of the shape memory alloy fibre wires 111 or ropes or other strands of a frame. In such circumstances, it will be appreciated that the wire 111 slides relative to the underlying sheet metal 121 during deformation. As indicated, an elemental scale element surface can be created by a number of cross members 112 secured upon wires 111. Furthermore, the cross members 112 can form an annulus extending around a gas turbine engine as required as encompassing loops. In such circumstances by judicious choice of the wires 111 which will deform, that is to say tighten and lengthen dependent upon temperature cycling, it will be understood that the cross members 112 will be brought in or expanded as required.

Figure 14:
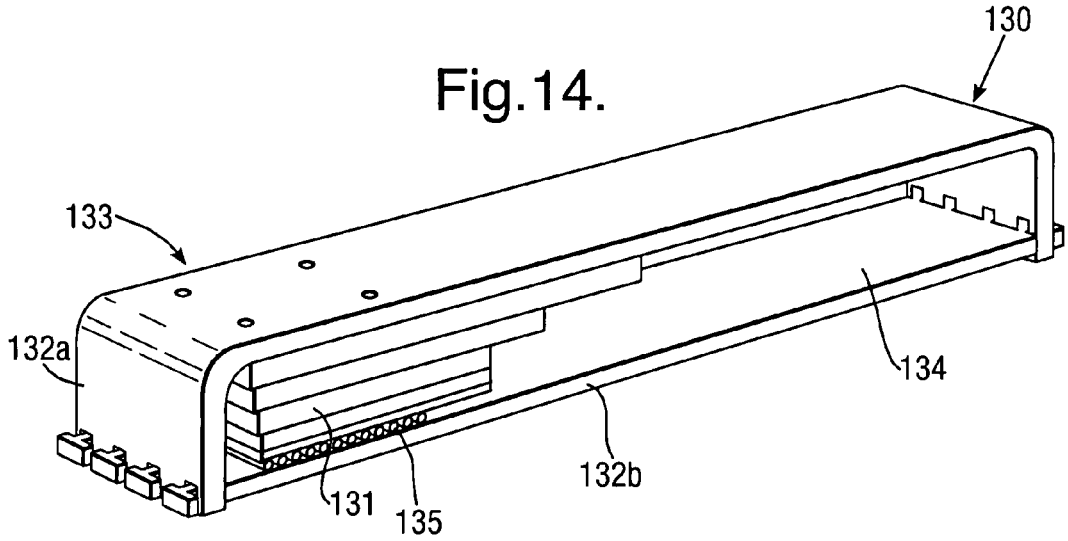
FIG. 14 is a schematic perspective view of a seventh embodiment of an actuator in accordance with aspects of the present invention.

FIG. 14 illustrates an eighth embodiment of an actuator in accordance with aspects of the present invention. The actuator 130 comprises a layer shape memory ply 131 located within a spring casing 132 formed by an upper part 132*a* and a lower part 132*b* located together by T slot mechanical interlocks. The shape memory material ply 131 is located through bolts or rivets 133 and the remainder of the housing 132 filled with an appropriate low thermal mass material 134. In use the shape memory material or alloy ply 131 contacts a lower part 132*b* through dowels 135 held in a picture frame retainer.

Figure 15:
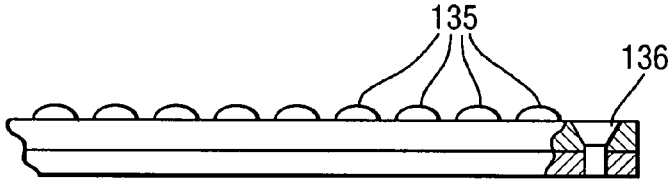
FIG. 15 is a side cross section of a dowel and picture frame presentation of slide elements in accordance with aspects of the present invention.

FIG. 15 provides a better illustration of the picture frame retention of the dowels 135. Generally, the dowels are stainless steel cylinders or tubes located within an open picture frame. The dowels are laid together, half exposed to create a roller surface to engage the housing part 132*b*. In such circumstances the shape memory alloy ply 131 will slide upon the dowels 135 in the frame 136 to avoid differential stress as a result of the shape memory alloy deforming.

Rather than use of roller dowels, it will be appreciated that ball bearings could be located within the frame 136 in order to provide a similar slide/roll association between the shape memory alloy ply 131 and housing 132.

Figure 16:
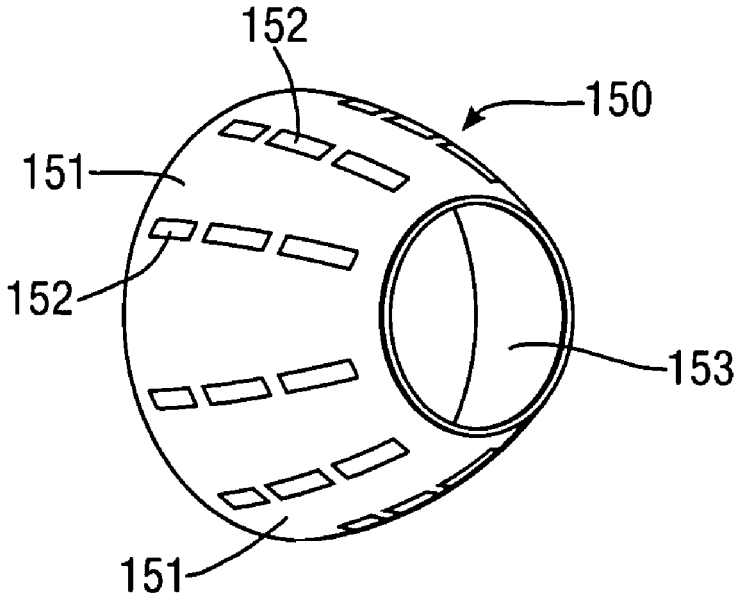
FIG. 16 is a schematic perspective view of an actuator in accordance with aspects of the present invention incorporated within an aperture size changing nozzle.

FIG. 16 illustrates an actuation accordance with aspects of the present invention utilised with regard to an aperture changing nozzle or similar device. In the actuator arrangement 150 a number of segments 151 are provided as petals associated together through roller spacer members 152. In use the segments 151 move radially inwards and outwards in order to vary the cross sectional area of an outlet nozzle 153. Such radial movement inwards and outwards will generally take the form of 2-5°. In such circumstances, in order to accommodate for this radial movement inwards and outwards loose fittings are needed. These spacers 152 are better illustrated with regard to FIG. 17.

Figure 17:
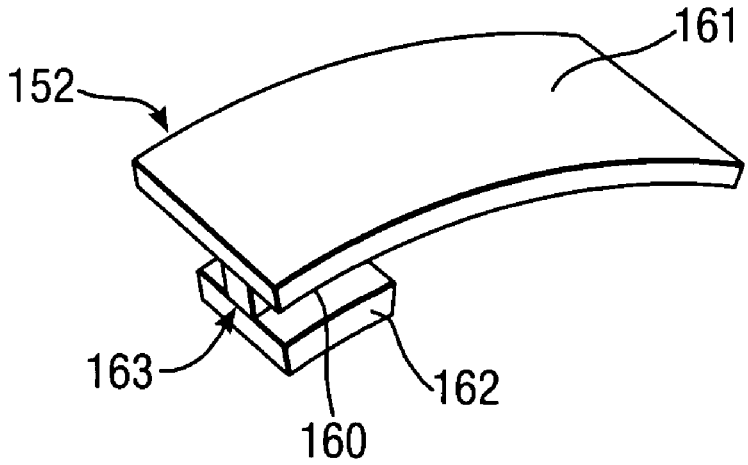
FIG. 17 is a schematic perspective view of a spacer in accordance with aspects of the present invention; and, FIG. 18 is a schematic end view of an eighth embodiment of an actuator in accordance with aspects of the present invention.

In FIG. 17 one of the spacers 152 is illustrated. As can be seen, the spacer 152 incorporates rebated sections 160 to engage the segments 151. These segments 151 generally incorporate a shape memory aspect such that they will deform depending upon temperature and, as indicated, cause radial inwards and outwards movement. By use of the spacer 152 in air washed wall 161 acts on one side of the segment 152 whilst a spacer part 162 acts on the other side in order to retain, in use with other spacers 152, the petals or segments 151 in association. Minimum spacing between the segments 152 is defined by a separator portion 163. In such circumstances, as indicated, the rebate 160 in association with other spacers 152 between segments 151 provide a slide element to allow those elements incorporated in a shape memory feature to vary radially inwards and outwards to the outlet cross sectional area 153. The spacers 152 through the material from which the spacer 152 is formed will create a bias towards a narrower cross sectional area 153 against which the shape memory deformation of the segments 151 acts.

Figure 18:
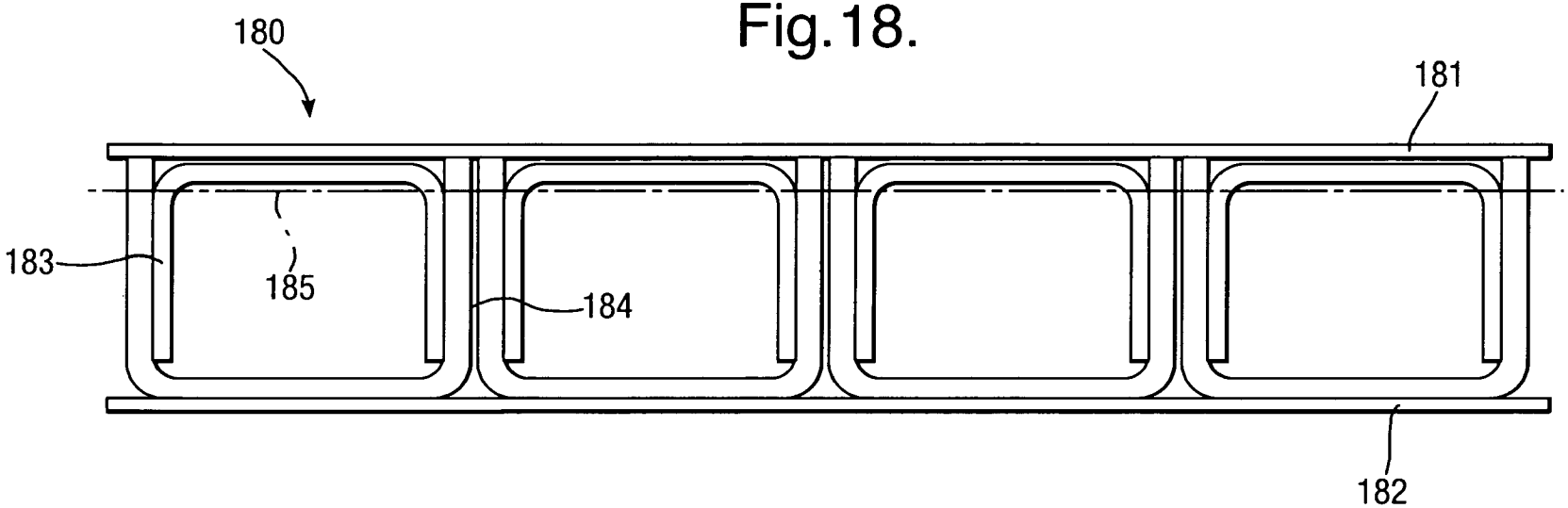

FIG. 18 illustrates a further embodiment of an actuator in accordance with aspects of the present invention. In the arrangement depicted in FIG. 18, essentially a number of actuators as described above with regard to FIG. 6, are assembled together sandwiched between surfaces for retention. In the arrangement 180 tapered U channel and bi-metallic shape memory actuators are linked using counter posed tensile members as bias elements. Thus, one surface 181 or 182 is subject to thermal cycling as a result of air wash. These surfaces 181, 182 are generally relatively thin sheets in order to transfer thermal load to the underlying actuators comprising, as indicated, U shaped channel bimetallic memory actuators comprising a shape memory element 183 are associated with a bias element 184. Typically, with an actuator arrangement as described with FIG. 6, dowels are provided along an axis 185, but through use of thin sheet surfaces 182, 183, may not be necessary to provide an upper row of such dowels in accordance with the embodiment depicted in FIG. 18. The wall sections of the U channels 183, 184 can be thinned and lightened by cutting windows, as described previously with regard to the embodiment depicted in FIG. 6.

Functionality with respect to the dowels, as indicated, can be achieved through provision of surface layers 182, 183, but it will be appreciated that dowels also perform a useful lateral interlocking function between the actuators formed by side by side U channels as described above. Similar association could be achieved through a floating tongue and groove relationship.

Aspects of the present invention provide for separation of the shape memory alloy parts of an actuator for deformation in terms of achieving orientation and shape changes in components such as blades or vanes or nozzle elements in a gas turbine engine. By separating the shape memory alloy or material from a spacer in the form of a roller or other slide element, stress differentiations across the shape memory alloy and actuator are substantially removed. Furthermore, by reducing the thermal mass of the directly coupled shaped memory alloy or material, that shape memory alloy material will be more responsive to thermal cycling and therefore the actuation time will be reduced.

In summary the present invention is an actuator (1, 11, 50, 71, 90, 130, 150) comprising a shape memory material element (2, 12, 32, 42, 52, 63, 91, 111, 112, 131, 183) and a bias element (4, 14, 34, 44, 54, 62, 92, 132, 184) arranged to act against one another and having a slide element (3, 13, 33, 43, 53, 93) placed between them, such that the actuator flexes the shape memory material, being in slidable contact with one of the elements and only allowing sliding between the slide element and the element. In this way the stiffness of the actuator and its ability to flex is not hindered by internal stresses between the interface of either element and the spacer/slide element. The present invention is also advantageous in that shape memory material is particularly difficult to bond other materials to.

We claim:

1. An actuator for a gas turbine engine, the actuator comprises:

a bias;

a slide element in contact with the bias; and a shape memory material in direct contact with the slide element and arranged to act against the bias and the slide element, with a the slide element being disposed between the bias and the shape memory material, the shape memory material being separate from the slide element so that the shape memory material is movable in relation to the slide element, and the shape memory material is movable in relation to the bias.

2. The actuator according to claim 1 wherein the shape memory material is a shape memory alloy.

3. The actuator according to claim 1 wherein the shape memory material is a sheet.

4. The actuator according to claim 1 wherein the shape memory material provides a wire or rope or strand.

5. The actuator according to claim 1 wherein the shape memory material comprises a bespoke shaped and formed element to provide desired actuation.

6. The actuator according to claim 1 wherein the slide element comprises a roller.

7. The actuator according to claim 1 wherein the slide element comprises a groove and/or guide eyes.

8. The actuator according to claim 1 wherein the slide element comprises a dowel.

9. The actuator according to claim 1 wherein the slide element comprises balls or other bearings.

10. The actuator according to claim 1 wherein the slide element is hollow.

11. The actuator according to claim 1 wherein the slide element incorporates location flanges.

12. The actuator according to claim 1 wherein the slide element is filled with a thermal mass material.

13. The actuator according to claim 1 wherein the actuator is curved.

14. The actuator according to claim 1 wherein the actuator is a blade or vane expander in a gas turbine engine.

15. The actuator according to claim 1 wherein the actuator incorporates an encapsulated wax to provide structural rigidity.

16. The actuator according to claim 1, wherein the slide member is movable in relation to the bias.

17. An actuator arrangement comprising a plurality of actuators for a gas turbine engine, each actuator comprising:

a bias;

a slide element in contact with the bias; and a shape memory material in direct contact with the slide element and arranged to act against the bias and the slide element, the slide element being disposed between the bias and the shape memory material, the shape memory material being separate from the slide element so that the shape memory material is movable in relation to the slide element, and the shape memory material is movable in relation to the bias, and the plurality of actuators being mechanically coupled together for co-ordinated action.

18. The arrangement according to claim 17 wherein the slide element of each actuator provides a lateral stiffness in an actuator arrangement structure.

* * * * *